US007960961B2

(12) United States Patent
Cave

(10) Patent No.: US 7,960,961 B2
(45) Date of Patent: Jun. 14, 2011

(54) BANDGAP CIRCUIT WITH TEMPERATURE CORRECTION

(75) Inventor: David Cave, Tempe, AZ (US)

(73) Assignee: Dolpan Audio, LLC, Dover, DE (US)

( * ) Notice: Subject to any disclaimer, the term of this patent is extended or adjusted under 35 U.S.C. 154(b) by 0 days.

(21) Appl. No.: 12/749,337

(22) Filed: Mar. 29, 2010

(65) Prior Publication Data

US 2010/0181986 A1 Jul. 22, 2010

Related U.S. Application Data

(63) Continuation of application No. 11/446,036, filed on Jun. 2, 2006, now Pat. No. 7,688,054.

(51) Int. Cl.
*G05F 3/30* (2006.01)

(52) U.S. Cl. ..... 323/313; 323/317; 323/907

(58) Field of Classification Search ..... 323/313, 323/316, 907, 314, 317, 315; 327/539
See application file for complete search history.

(56) References Cited

U.S. PATENT DOCUMENTS

| | | | | |
|---|---|---|---|---|
| 5,229,710 | A | 7/1993 | Kraus et al. | |
| 5,712,590 | A | 1/1998 | Dries et al. | |
| 6,157,245 | A | 12/2000 | Rincon-Mora | |
| 6,218,822 | B1 | 4/2001 | MacQuigg | |
| 6,225,850 | B1 | 5/2001 | Opris | |
| 6,642,699 | B1 | 11/2003 | Gregoire, Jr. | |
| 6,677,808 | B1 | 1/2004 | Sean et al. | |
| 6,724,176 | B1 | 4/2004 | Wong et al. | |
| 7,224,209 | B2 | 5/2007 | Hsu | |
| 2005/0122091 | A1 * | 6/2005 | Marinca | 323/316 |

* cited by examiner

*Primary Examiner* — Harry Behm
(74) *Attorney, Agent, or Firm* — Knobbe Martens Olson & Bear LLP

(57) ABSTRACT

A temperature corrected voltage bandgap circuit is provided. The circuit includes first and second diode connected transistors. A first switched current source is coupled to the one transistor to inject or remove a first current into or from the emitter of that transistor. The first current is selected to correct for curvature in the output voltage of the bandgap circuit at one of hotter or colder temperatures.

14 Claims, 8 Drawing Sheets

BANDGAP CIRCUIT WITH TEMPERATURE CORRECTION

RELATED APPLICATIONS

This application is a continuation of U.S. application Ser. No. 11/446,036, filed Jun. 2, 2006, which is incorporated by reference herein in its entirety.

FIELD OF THE INVENTION

The present invention pertains to temperature sensing, in general, and to an improved bandgap circuit, in particular.

BACKGROUND OF THE INVENTION

To measure temperature, a common method utilizes a sensor to convert the quantity to be measured to a voltage. Common solid state sensors utilize semiconductor diode Vbe, the difference in Vbe at two current densities or delta Vbe, or a MOS threshold to provide a temperature dependent output voltage. The temperature is determined from the voltage measurement. Once the sensor output is converted to a voltage it is compared it to a voltage reference. It is common to utilize a voltage reference having a low temperature coefficient such as a bandgap circuit as the voltage reference. The bandgap voltage reference is about 1.2 volts. An n-bit analog to digital converter divides the bandgap reference down by $2^n$ and determines how many of these small pieces are needed to sum up to the converted voltage. The precision of the A/D output is no better than the precision of the bandgap reference.

Typical plots of the output bandgap voltage with respect to temperature are bowed and are therefore of reduced accuracy.

Prior bandgap voltage curvature correction solutions result in very complicated circuits whose performance is questionable.

SUMMARY OF THE INVENTION

In accordance with the principles of the invention, a temperature corrected bandgap circuit is provided which provides a significantly flatter response of the bandgap voltage with respect to temperature.

In accordance with the principles of the invention, a temperature corrected voltage bandgap circuit is provided. The circuit includes first and second diode connected transistors with the area of one transistor being selected to be a predetermined multiple of the area of the other transistor. A first switchable current source is coupled to the one transistor to inject a first current into the emitter of that transistor when its base-emitter voltage is at a first predetermined level. The first current is selected to correct for curvature in the output voltage of the bandgap circuit at one of hotter or colder temperatures.

Further in accordance with the principles of the invention a second current source is coupled to the other transistor to remove a second current from the other transistor emitter. The second current is selected to correct for curvature in the output voltage at the other of said hotter or colder temperatures. The current removal of the second current source is initiated when the base-emitter voltage of the other transistor reaches a predetermined level.

The bandgap circuit, the first current source and the second current source are formed on a single substrate.

BRIEF DESCRIPTION OF THE DRAWINGS

The invention will be better understood from a reading of the following detailed description in conjunction with the drawing figures in which like reference designators identify like elements, and in which.

DETAILED DESCRIPTION

For a bipolar transistor the first order equation for collector current related to Vbe is:

$$I_c = AI_s(e^{(Vbe\cdot q)/kT} - 1)$$

where:

T is temperature in Kelvin;

A is an area scale;

$I_s$ is dark current for a unit area device (process dependent);

q is charge on the electron; and

K is Boltzman's constant.

In the forward direction, even at very low bias, the $(e^{(Vbe\cdot q)/kT})$ over-powers the −1 term. Therefore in the forward direction:

$$I_c = I_s(e^{(Vbe\cdot q)/kT})$$

, and $$V_{be} = (kT/q)\cdot\ln(I_c/AI_s)$$

Two junctions operating at different current densities will have a different Vbe related by the natural logs of their current densities.

From this it can be shown that the slope of Vbe vs. temperature must depend on current density. Vbe has a negative temperature coefficient. However, the difference in Vbe, called the ΔVbe, has a positive temperature coefficient.

$$\Delta Vbe = Vbe|_1 - Vbe|_A = (kT/q)\cdot[\ln(I_1/I_s) - \ln(I_2/AI_s)]$$

For $I_1 = I_2$ and an area scale of A $$\Delta Vbe = (kT/q)\ln A$$

In the illustrative embodiment of the invention, a bandgap circuit is formed as part of a CMOS device of the type utilizing CMOS N-well process technology.

Figure 1:
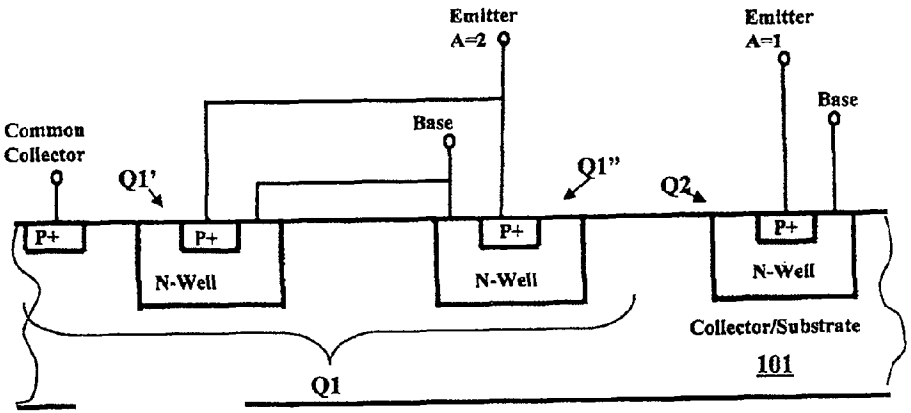
FIG. 1 PRIOR ART
FIG. 1 illustrates a prior art CMOS N-well substrate having a bipolar transistor structure of a type that may be utilized in a bandgap circuit.
Figure 2:
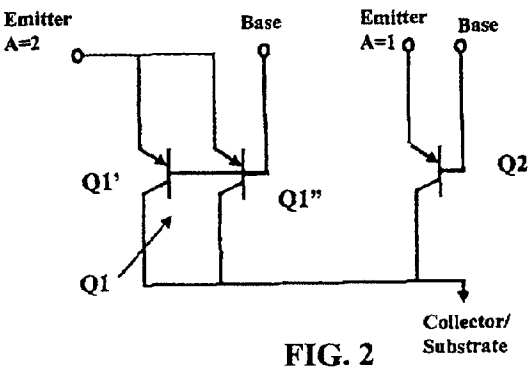
FIG. 2 PRIOR ART
FIG. 2 is a schematic of the prior art bipolar structure of FIG. 1.

The most usable bipolar transistors available in the CMOS N-well process is the substrate PNP as shown in FIG. 1 in which a single transistor Q1 is formed by transistors Q1', Q1" which has an area ratio, A, that is twice that of the transistor Q2. The structure is shown in schematic form in FIG. 2. All the collectors of transistors Q1', Q1", Q2 are connected to the chip substrate 101, i.e., ground. There is direct electrical access to the base and emitter of each transistor Q1', Q1", Q2 to measure or control Vbe but there is no separate access to the collectors of the transistors Q1', Q1", Q2 to monitor or control collector current.

There are several general topologies based on the standard CMOS process and its substrate PNP that can be used to create a bandgap circuit.

Figure 3:
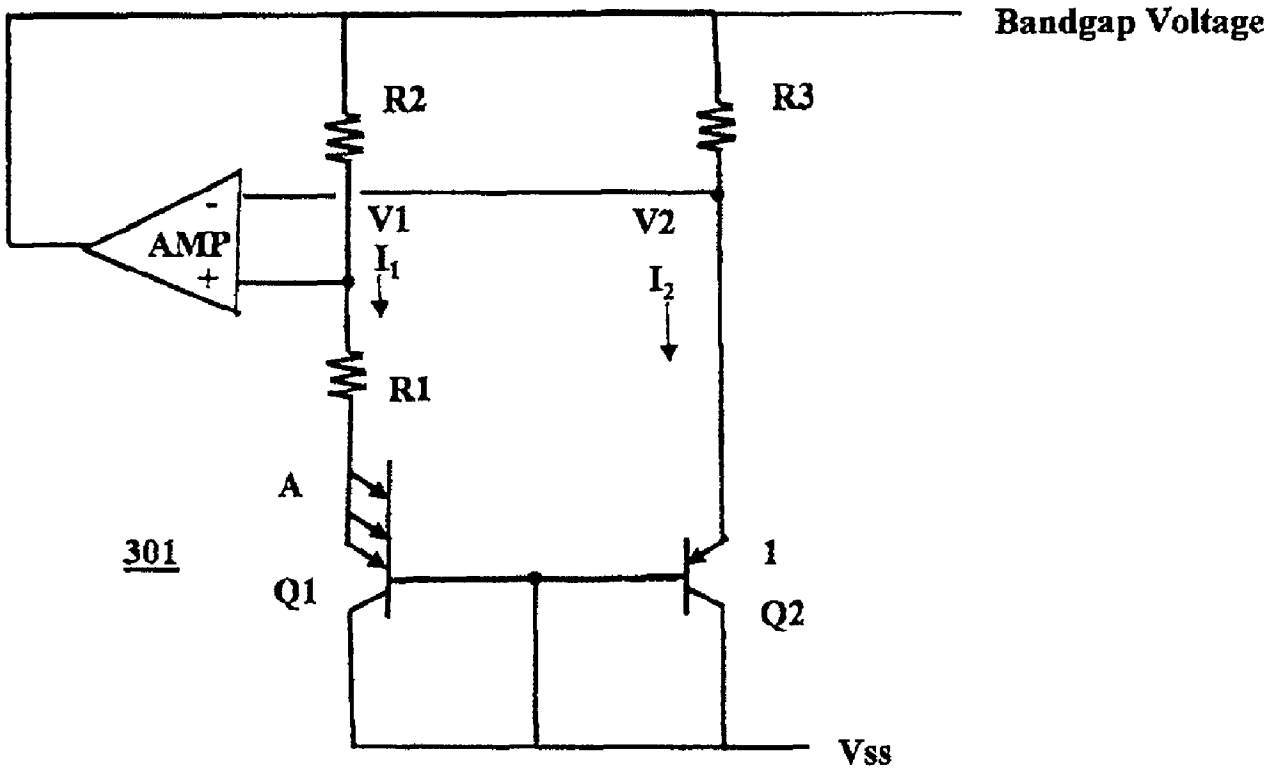
FIG. 3 PRIOR ART
FIG. 3 is a schematic of a prior art bandgap circuit.

FIG. 3 illustrates a prior art bandgap circuit 301 architecture. Bandgap circuit 301 comprises transistor Q1 and transistor Q2. The area of transistor Q1 is selected to be a predetermined multiple A of the area of transistor Q2. First and second serially connected resistors R1, R2 are connected between an output node Vbandgap and the emitter of transistor Q2. A third resistor is connected in series between output node Vref and the emitter of transistor Q1. A differential input amplifier AMP has a first input coupled to a first circuit node disposed between resistors R1, R2; and a second input coupled to a second node disposed between resistor R3 and the emitter of transistor Q1. Amplifier AMP has its output coupled to the output node bandgap.

Bandgap voltage and slope with respect to temperature or temperature coefficient, TC, are sensitive to certain process and design variables.

With the foregoing in mind, considering all the variables, and making specific assumptions, a closed form for the bandgap voltage is:

$$V\text{bandgap}=(kT/q)\cdot\{\ln[((kT/q)\cdot\ln A/R_1)/I_s]\}+(1+R_2/R_1)(kT/q)\cdot\ln A$$

This is of the form Vref=Vbe+m ΔVbe

When m is correctly set, the temperature coefficient of Vref will be near zero. The resulting value of Vref will be near the bandgap voltage of silicon at 0° K, thus the name "bandgap circuit."

Figure 4:
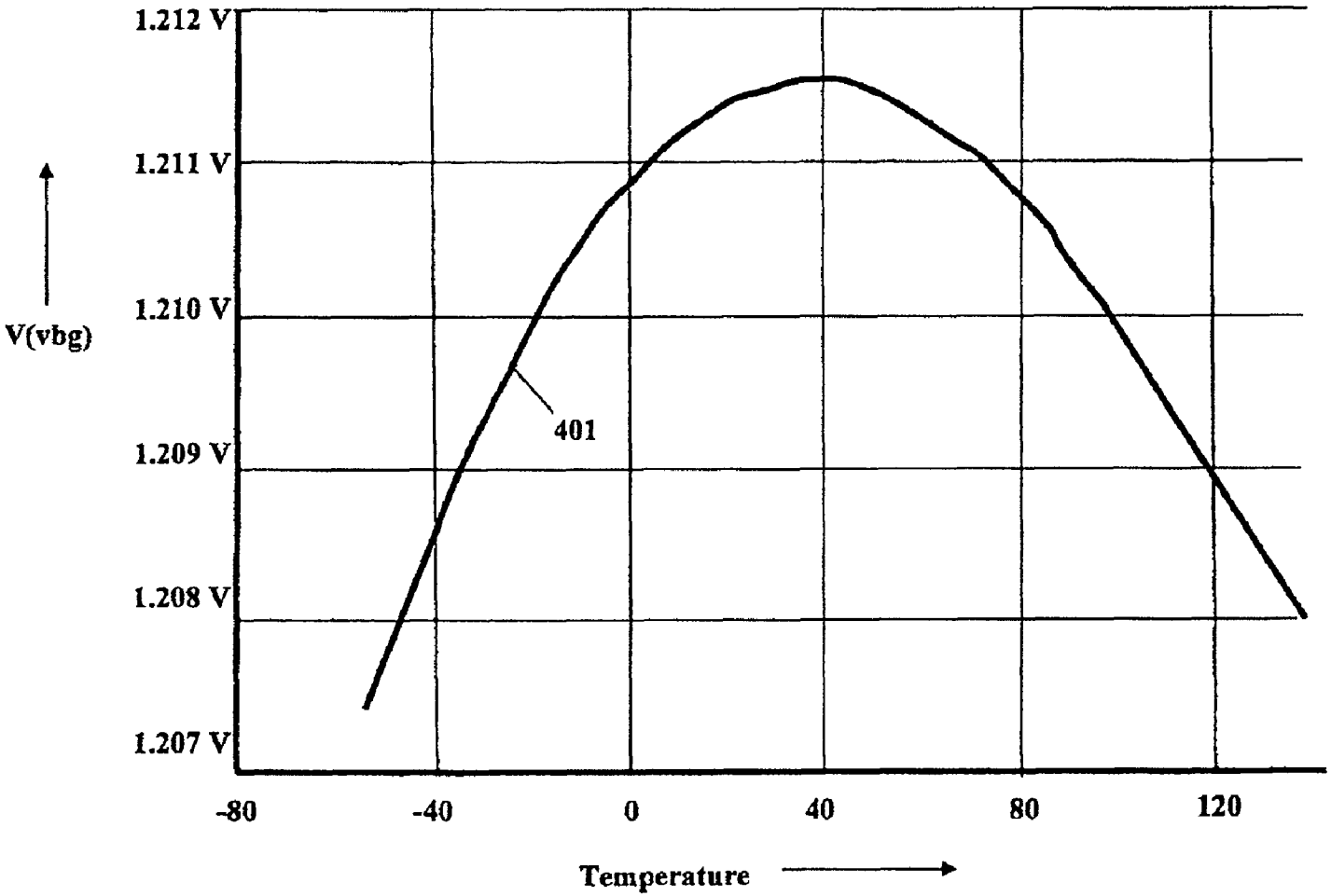
FIG. 4 PRIOR ART
FIG. 4 is a typical plot of bandgap circuit voltage versus temperature for the prior art circuit of FIG. 4.

However, Vbe for a bipolar transistor operating at constant current has a slight bow over temperature. The net result is that a plot of bandgap voltage Vref against temperature has a bow as shown by curve 401 in FIG. 4.

Figure 5:
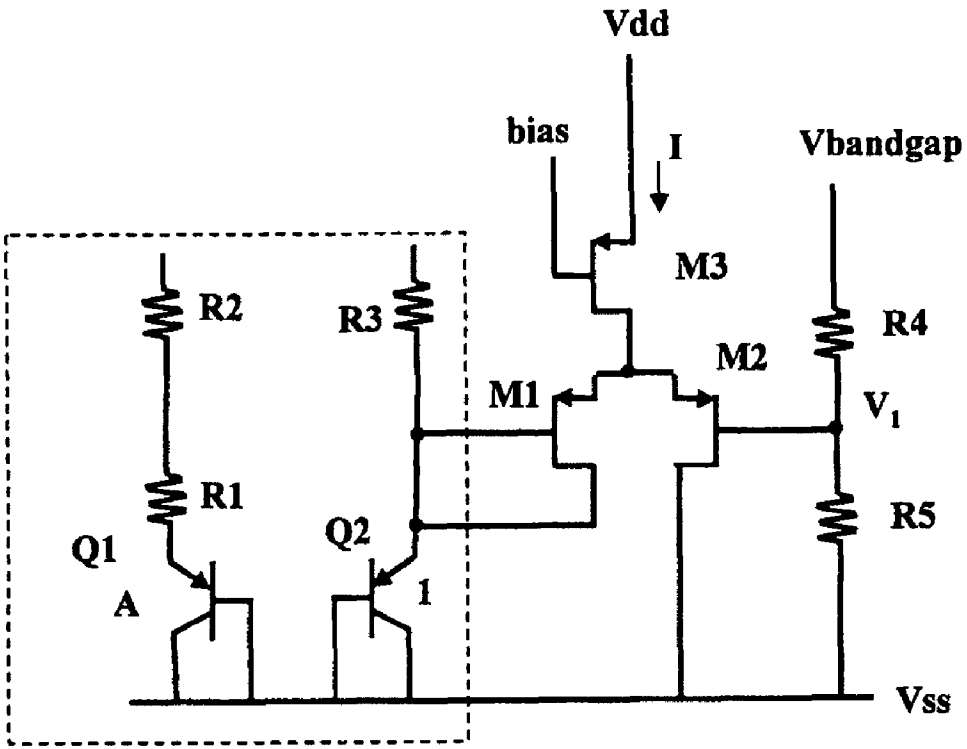
FIG. 5 is a schematic of a circuit in accordance with the principles of the invention.

In accordance with one aspect of the invention, a simple differential amplifier formed by transistors M1, M2 as shown in FIG. 5 is used and a comparison is made between a near zero temperature coefficient voltage from the bandgap to the negative temperature coefficient of the bandgap Vbe. By providing proper scaling to add or subtract a controlled current to the bandgap at hot and cold temperatures the bandgap curve is flattened.

FIG. 5 illustrates a portion of a simplified curvature corrected bandgap circuit in accordance with the principles of the invention.

Transistor M1 and transistor M2 compare the nearly zero temperature coefficient, TC, voltage V1 (derived from the bandgap) to the Vbe voltage of the unit size bipolar transistor Q2 in the bandgap. By adjusting the value of V1 the threshold temperature where the differential pair M1, M2 begins to switch and steer current provided by transistor M3 into the bandgap is moved. Voltage V1 is selected to begin adding current at the temperature where the bandgap begins to dip, e.g., 40° C. The width/length W/L ratio of transistors M1, M2 will define the amount of differential voltage necessary to switch all of the current from transistor M2 to transistor M1. The current I sets the maximum amount of current that can or will be added to the bandgap.

In accordance with the principles of the invention, by utilizing 3 transistors and 2 resistors the correction threshold, rate (vs. temperature) and amount of curvature (current) correction on the high temperature side can be corrected. The effect of this current injection is shown by curve 601 in FIG. 6

Figure 7:
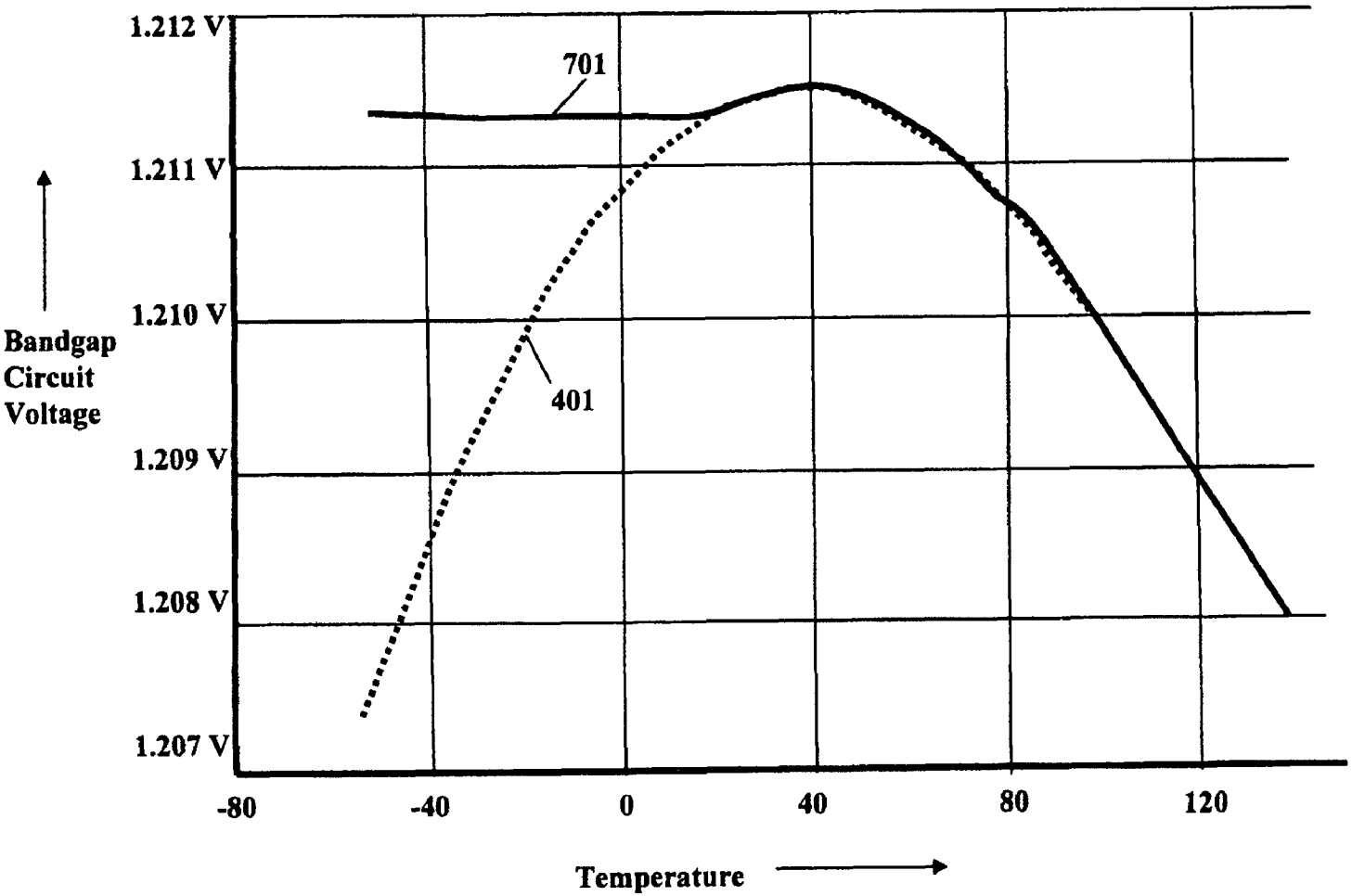
FIG. 7 is a plot of bandgap circuit voltage versus temperature with low temperature compensation in accordance with the principles of the invention.

The comparator/current injection structure can be mirrored for curvature correction of the cold temperature side of the bandgap by providing current removal from the larger or A sized transistor Q1 of the bandgap circuit. The effect of such curvature correction on the cold side is shown by curve 701 in FIG. 7.

Figure 9:
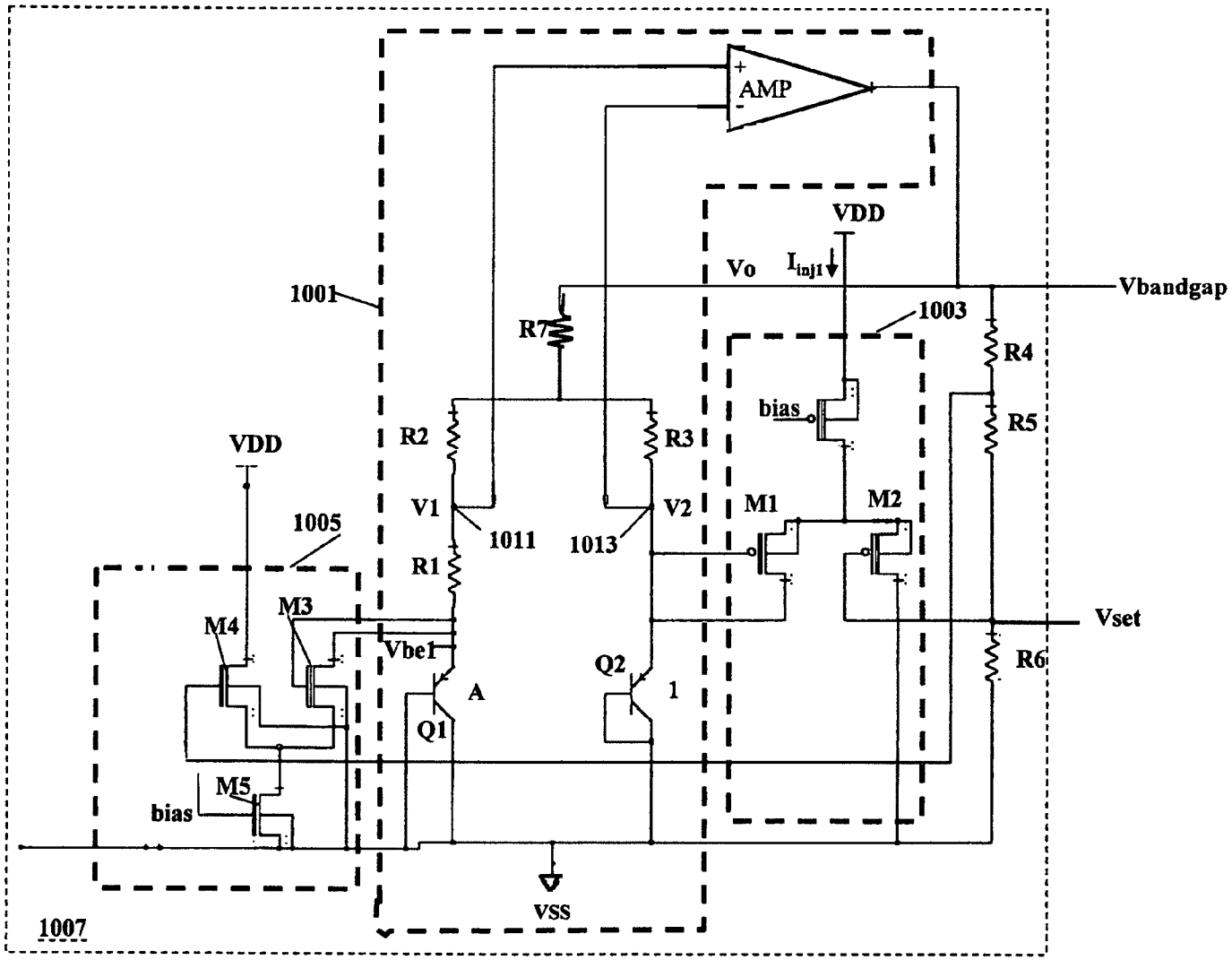
FIG. 9 is a schematic of a bandgap circuit in accordance with the principles of the invention.

A fully compensated bandgap circuit in accordance with the principles of the invention that provides both hot and cold temperature compensation is shown in FIG. 9.

Figure 8:
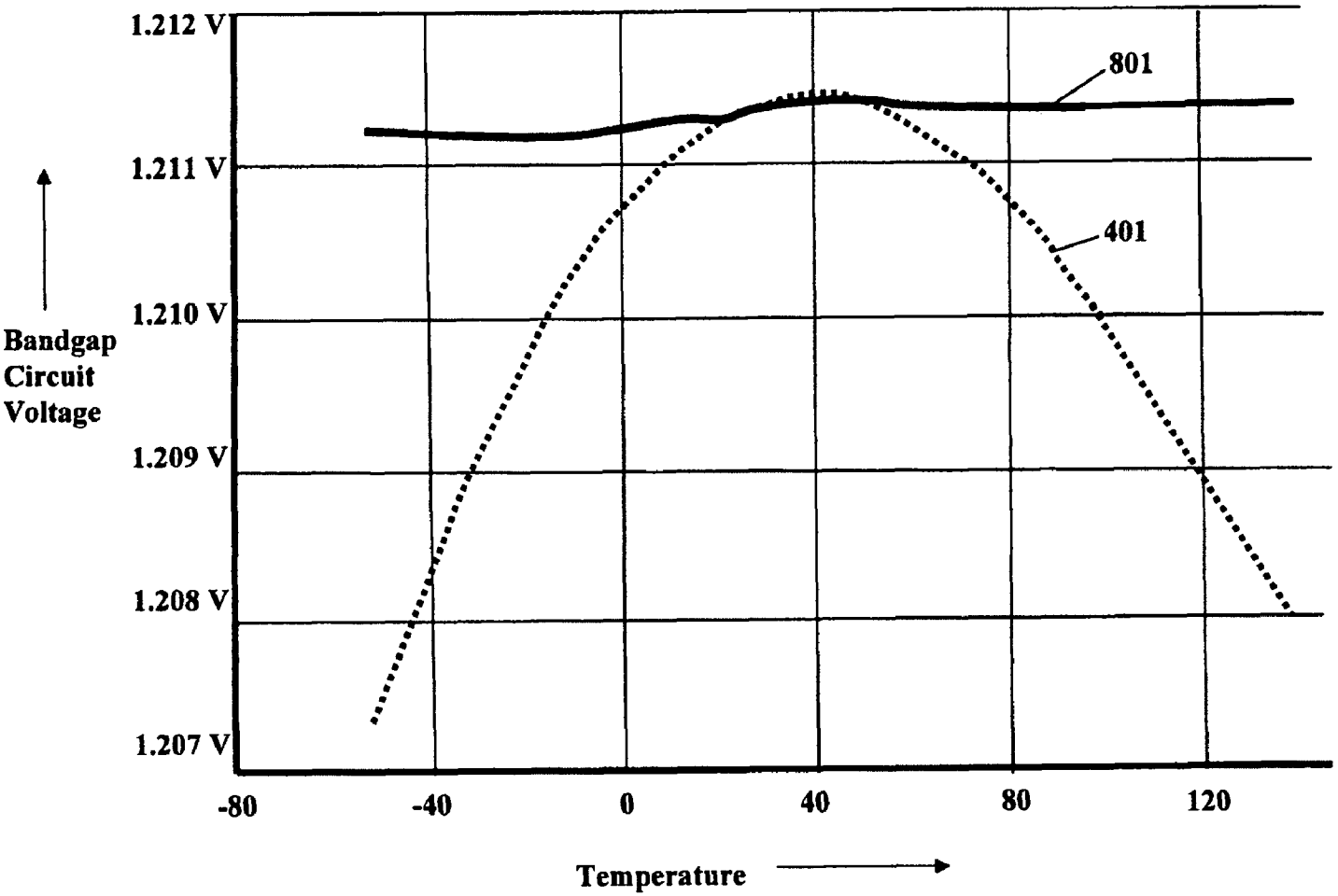
FIG. 8 is a plot of bandgap circuit voltage versus temperature with high and low temperature compensation in accordance with the principles of the invention.

The circuit of FIG. 9 shows substantial improvement in performance over a temperature range of interest is −40 to 125° C. A plot of Vref versus temperature is shown in FIG. 8 as curve 801.

The compensated circuit of FIG. 9 includes bandgap circuit 1001, current injection circuit 1003 and current injection circuit 1005.

Bandgap circuit 1001 comprising a transistor Q2 and a transistor Q1. The area of transistor Q1 is selected to be a predetermined multiple A of the area of transistor Q2. First and second serially connected resistors R1, R2 are connected between an output node Vbandgap and the emitter of transistor Q2. A third resistor is connected in series between output node Vref and the emitter of transistor Q1. A differential input amplifier AMP has a first input coupled to a first circuit node disposed between resistors R1, R2; and a second input coupled to a second node disposed between resistor R3 and the emitter of transistor Q1. Amplifier AMP has its output coupled to the output node Vbandgap.

A first switchable current source 1003 is coupled to said transistor Q2 to inject a first current into the emitter of transistor Q2. The current $I_{inj1}$ is selected to correct for one of hotter or colder temperatures, more specifically, in the illustrative embodiment, the current $I_{inj1}$ is injected at higher temperatures when the base emitter voltage across transistor Q2 to a first predetermined voltage Vset. The voltage Vset is determined by a resistance network formed by resistors R4, R5, R6.

A second switchable current source 1005 is coupled to transistor Q1 to remove a second current $I_{inj2}$ into the emitter of transistor Q1. The second current $I_{inj2}$ is selected to correct for the other of the hotter or colder temperatures, and more specifically for colder temperatures.

Bandgap circuit 1001, and switchable current injection circuits 1003, 1005 are formed on a single common substrate 1007.

The resistors R4, R5, and R6 are trimmable resistors and are utilized to select the voltages at which the current sources inject current from switchable current injection circuits 1003, 1005 into bandgap circuit 1001.

The invention has been described in terms of illustrative embodiments. It is not intended that the scope of the invention be limited in any way to the specific embodiments shown and described. It is intended that the invention be limited in scope only by the claims appended hereto, giving such claims the broadest interpretation and scope that they are entitled to under the law. It will be apparent to those skilled in the art that various changes and modifications can be made without departing from the spirit or scope of the invention. It is intended that all such changes and modifications are encompassed in the invention as claimed.

What is claimed is:

1. A circuit comprising:

a bandgap circuit configured to output a reference voltage;

a first switchable current source coupled to the bandgap circuit and configured to inject a first current into the bandgap circuit to correct the output reference voltage of the bandgap circuit for one of hotter or colder temperatures;

a second switchable current source coupled to the bandgap circuit and configured to remove a second current from the bandgap circuit to correct the output reference voltage of the bandgap circuit for the other of hotter or colder temperatures;

a first transistor, wherein the first switchable current source is coupled to the first transistor and configured to inject the first current into the emitter of the first transistor;

a second transistor, wherein the second switchable current source is coupled to the second transistor and configured to remove the second current from the emitter of the second transistor; and a resistance network including three trimmable resistors, wherein the resistance network is coupled to the first switchable current source, the second switchable current source, the collectors of the first and second transistors, and the bandgap voltage output node, and wherein the bandgap circuit is configured such that the three trimmable resistors are configured to select the voltages at which the first and second switchable current sources inject and remove current, respectively, into/from the bandgap circuit.

2. The circuit of claim 1, wherein the first switchable current source is configured to inject the first current into the emitter of the first transistor when the base emitter voltage of the first transistor is at a first predetermined voltage level.

3. The circuit of claim 1, wherein the second switchable current source is configured to remove the second current from the emitter of the second transistor when the base emitter voltage of the second transistor is at a second predetermined voltage level.

4. A circuit comprising:

a bandgap circuit configured to provide an output reference voltage, wherein the bandgap circuit includes a first transistor and a second transistor;

means for injecting a first current coupled to the first transistor, wherein the means for injecting is configured to inject a first current into the first transistor to correct the output reference voltage of the bandgap circuit for high temperatures; and means for removing a second current coupled to the second transistor, wherein the means for removing is configured to remove a second current provided to the second transistor to correct the output of the bandgap circuit for low temperatures.

5. The circuit of claim 4, wherein the means for injecting a first current comprises a first current source, wherein the first current source is further coupled to the emitter of the first transistor, and wherein the first current source is further configured to inject the first current into the emitter of the first transistor.

6. The circuit of claim 5, wherein the first current source is configured to inject the first current into the emitter of the first transistor in response to a voltage received from the emitter of the first transistor.

7. The circuit of claim 5, wherein the first current source is configured to inject the first current into the emitter of the first transistor when the base emitter voltage across the first transistor is at a first predetermined voltage level.

8. The circuit of claim 7, wherein the means for removing a second current comprises a second current source, the circuit further comprises a resistance network coupled to the first current source, the second current source, and the output of the bandgap circuit, wherein the first predetermined voltage level is determined by the resistance network.

9. The circuit of claim 4, wherein the means for removing a second current comprises a second current source, wherein the second current source is further coupled to the emitter of the second transistor, and wherein the second current source is configured to remove the second current from the emitter of the second transistor.

10. The circuit of claim 9, wherein the second current source is configured to remove the second current from the emitter of the second transistor in response to a voltage received from the emitter of the second transistor.

11. The circuit of claim 9, wherein the second current source is configured to remove the second current from the emitter of the second transistor when the base emitter voltage across the second transistor is at a second predetermined voltage level.

12. The circuit of claim 4, wherein the means for injecting a first current comprises a first current source, wherein the means for removing a second current comprises a second current source, the circuit further comprising a resistance network including a plurality of trimmable resistors coupled to the first current source, the second current source, and the bandgap circuit, and wherein the resistance network is configured to select the voltages at which the first and second current sources inject and remove current, respectively, into/from the bandgap circuit.

13. The circuit of claim 4, wherein each of the means for injecting a first current and means for removing a second current comprise MOS transistors.

14. The circuit of claim 4, wherein the means for injecting a first current and the means for removing a second current are formed on a single substrate.

* * * * *

UNITED STATES PATENT AND TRADEMARK OFFICE

CERTIFICATE OF CORRECTION

PATENT NO. : 7,960,961 B2
APPLICATION NO. : 12/749337
DATED : June 14, 2011
INVENTOR(S) : Cave It is certified that error appears in the above-identified patent and that said Letters Patent is hereby corrected as shown below:

Column 6, line 38, in Claim 12, delete “comprising” and insert -- comprises --.

Signed and Sealed this
Eighteenth Day of October, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,960,961 B2
APPLICATION NO. : 12/749337
DATED : June 14, 2011
INVENTOR(S) : David Cave It is certified that error appears in the above-identified patent and that said Letters Patent is hereby corrected as shown below:

In the Specification

In column 2, at line 40 (approx.), Change "Boltzman's" to --Boltzmann's--.

In column 3, at line 17, Change "Q2" to --Q1--.

In column 3, at line 18, Change "Vref" to --Vbandgap--.

In column 3, at line 18, Change "Q1" to --Q2--.

In column 3, at line 22, Change "Q1" to --Q2--.

In column 3, at line 23, Change "bandgap" to --Vbandgap--.

Figure 6:
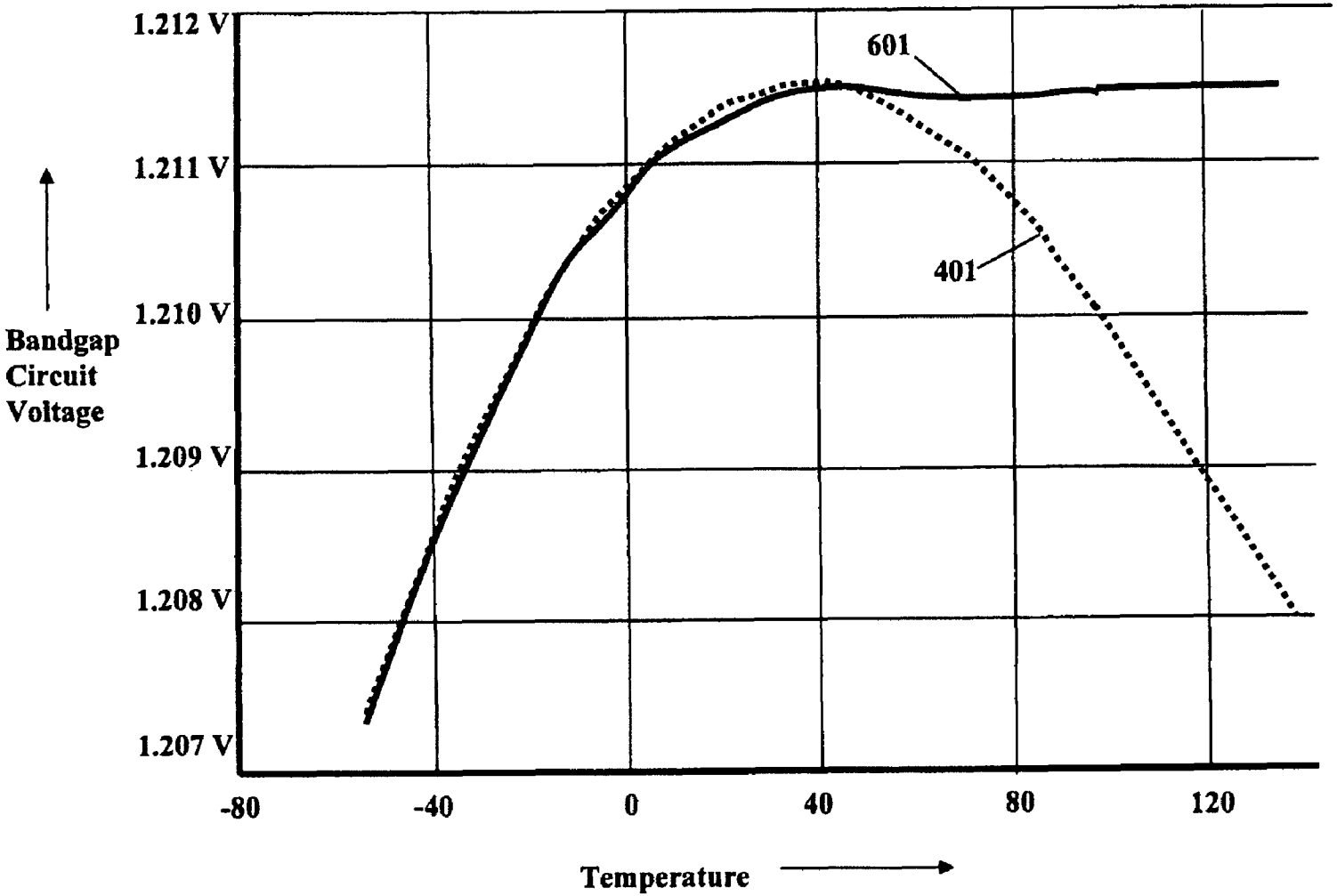
FIG. 6 is a plot of bandgap circuit voltage versus temperature with high temperature compensation in accordance with the principles of the invention.

In column 4, at line 4, after "FIG. 6" insert --.--.

In column 4, at line 26, Change "Q2" to --Q1--.

In column 4, at line 27, Change "Vref" to --Vbandgap--.

In column 4, at line 27, Change "Q1" to --Q2--.

In column 4, at line 31, Change "Q1" to --Q2--.

In column 4, at line 39, Change "to" to --is--.

Signed and Sealed this
Thirteenth Day of August, 2013

Teresa Stanek Rea
*Acting Director of the United States Patent and Trademark Office*